US007447472B2

(12) United States Patent
Sugiyama

(10) Patent No.: US 7,447,472 B2
(45) Date of Patent: Nov. 4, 2008

(54) MECHANISM FOR SELECTIVELY APPLYING VARIABLE PRESSURE PROFILES TO A RECORDING MEDIUM

(75) Inventor: Yasuhisa Sugiyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/020,368

(22) Filed: Dec. 23, 2004

(65) Prior Publication Data

US 2005/0141932 A1 Jun. 30, 2005

(30) Foreign Application Priority Data

Dec. 26, 2003 (JP) ..... 2003-434304

(51) Int. Cl.
*G03G 15/20* (2006.01)

(52) U.S. Cl. ..... 399/328; 399/44; 399/45

(58) Field of Classification Search ..... 399/328, 399/320, 44, 45, 68

See application file for complete search history.

(56) References Cited

U.S. PATENT DOCUMENTS

| | | | | |
|---|---|---|---|---|
| 7,020,424 | B2 * | 3/2006 | Gilmore et al. | 399/329 |
| 7,200,345 | B2 * | 4/2007 | Katayanagi et al. | 399/45 |
| 2002/0118982 | A1 * | 8/2002 | Fuma | 399/329 |
| 2005/0111862 | A1 * | 5/2005 | Fuma et al. | 399/67 |
| 2005/0191071 | A1 * | 9/2005 | Katayanagi et al. | 399/45 |

FOREIGN PATENT DOCUMENTS

| | | | |
|---|---|---|---|
| JP | 55004075 | A * | 1/1980 |
| JP | 56075681 | A * | 6/1981 |
| JP | 59097168 | A * | 6/1984 |
| JP | 07215512 | A * | 8/1995 |
| JP | 08202198 | A * | 8/1996 |
| JP | 2000-259024 | A | 9/2000 |
| JP | 2002148981 | A * | 5/2002 |
| JP | 2002148981 | A1 | 5/2002 |

OTHER PUBLICATIONS

Partial English Translation of Japanese Patent Laid-Open Patent Application No. 2002-148981 (Shimomura et al.), Published—May 22, 2002.

* cited by examiner

*Primary Examiner*—Quana M Grainger
(74) *Attorney, Agent, or Firm*—Panitch Schwarze Belisario & Nadel LLP

(57) ABSTRACT

A fixing apparatus operates to fix a toner image on a recording medium. A heating member extends in a first direction transverse to a second direction in which a recording medium travels for fixing. A belt contacts the heater member to form a fixing region between the belt and the heating member. A pressure member presses the belt against the heating member. A pressing mechanism engages the pressure member to apply a predetermined pressure to the pressure member toward the fixing region in such a way that the pressure has a predetermined profile of distribution in the first direction. The pressing mechanism may be a rotatable member. When the rotatable member rotates, the surface of the rotatable member moves into pressure contact engagement with the pressure member.

18 Claims, 14 Drawing Sheets

MECHANISM FOR SELECTIVELY APPLYING VARIABLE PRESSURE PROFILES TO A RECORDING MEDIUM

BACKGROUND OF THE INVENTION

1. Field of the Invention

The present invention relates to a fixing apparatus and an image-forming apparatus.

2. Description of the Related Art

Among image-forming apparatus are a printer, a copying machine, and a facsimile machine that use an electrophotographic image-forming process. Such an image-forming apparatus is equipped with a fixing unit in which a toner image deposited on a recording medium is fused into a permanent image. The fixing unit includes a heat roller having a built-in heater therein, a pressure pad that opposes the heat roller, and a fixing belt that is sandwiched between the heat roller and the pressure pad and pressed against the heat roller by the pressure pad.

The pressure pad presses the fixing belt against the heat roller to create a nip between the fixing belt and the heat roller. However, the aforementioned conventional fixing unit suffers from the problem that the nip region is difficult to be uniform for different types of recording medium and non-uniform nips cause poor print quality.

SUMMARY OF THE INVENTION

The present invention was made in view of the aforementioned problems.

An object of the invention is to provide a fixing apparatus and an image-forming apparatus where a uniform nip can be formed to improve image quality.

A fixing apparatus operates to fix a toner image on a recording medium. A heating member extends in a first direction transverse to a second direction in which a recording medium travels for fixing. A belt contacts the heater member to form a fixing region between the belt and the heating member. A pressure member presses the belt against the heating member. A pressing mechanism engages the pressure member to apply a predetermined pressure to the pressure member toward the fixing region in such a way that the pressure has an adjustable profile of distribution in the first direction.

The pressing mechanism is a rotatable member that extends in a third direction substantially parallel to the first direction. The rotatable member has a surface that is brought into contact engagement with the pressure member when the rotatable member is rotated, the surface has a predetermined profile of geometry in the third direction such that the pressing force has the predetermined profile of distribution in the first direction.

The fixing apparatus may further include a deformable resilient member disposed between the pressing mechanism and the pressure member, the deformable resilient member extending in a direction generally parallel to the first direction.

The pressing mechanism includes a plurality of sub-mechanisms aligned in a direction generally parallel to the first direction. The plurality of sub-mechanisms are adjustable independently so that each of the plurality of sub-mechanisms applies different amounts of force to the pressure member.

An image-forming apparatus has a fixing apparatus. The fixing apparatus includes:

a heating member that extends in a first direction transverse to a second direction in which a recording medium is advanced;

a belt that is in contact with the heater member to form a fixing region between the belt and the heating member so that the recording medium passes through the fixing region for fixing;

a pressure member that presses the belt against the heating member;

a pressing mechanism that engages the pressure member to apply a pressing force to the pressure member toward the fixing region; and a controller that drives the pressing mechanism to adjust the pressing force in such a way that the pressing force has an adjustable profile of distribution in the first direction.

The pressing mechanism of the image-forming apparatus is rotatable and extends in a third direction substantially parallel to the first direction, wherein the pressing mechanism has a surface that is brought into contact engagement with the pressure member to apply a pressing force to the pressure member toward the fixing when the rotatable member is rotated, the surface having a predetermined profile of geometry in the third direction such that the pressing force has the predetermined profile of distribution in the first direction.

The fixing apparatus of the image-forming apparatus further includes a deformable resilient member disposed between the pressing mechanism and the pressure member, the deformable resilient member extending in a direction generally parallel to the first direction.

The pressing mechanism of the image-forming apparatus includes a plurality of sub-mechanisms aligned in a direction generally parallel to the first direction. The plurality of sub-mechanisms are adjustable independently so that each of the plurality of sub-mechanisms applies different amounts of force to the pressure member.

The controller drives the plurality of sub-mechanisms in accordance with information on the recording medium.

The controller drives the plurality of sub-mechanisms in accordance with at least one of environmental temperature and humidity.

The controller determines a print duty based on image data that should be printed on the recording medium, the controller adjusting the profile of distribution in accordance with the print duty.

A fixing apparatus includes:

a heating member that extends in a first direction transverse to a second direction in which a recording medium is advanced;

a belt that is in contact with the heater member to form a fixing region between the belt and the heating member so that the recording medium passes through the fixing region for fixing;

a pressure member that presses the belt against the heating member;

a pressing mechanism that engages the pressure member to apply a predetermined pressing force to the pressure member toward the fixing region in such a way that the pressing force has a predetermined profile of distribution in the first direction.

An image-forming apparatus incorporates the aforementioned fixing apparatus. The image-forming apparatus includes a controller that drives the pressing mechanism to adjust the pressing force in such a way that the pressing force has a predetermined profile of distribution in the third direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Overall Construction

The present invention will be described with reference to the accompanying drawings. A printer will be described as an example of an image forming apparatus.

Figure 1B:
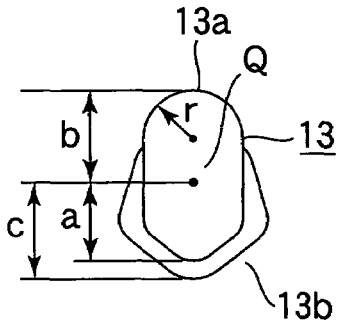
FIG. 1B illustrates a partial expanded view of FIG. 1A.
Figure 1A:
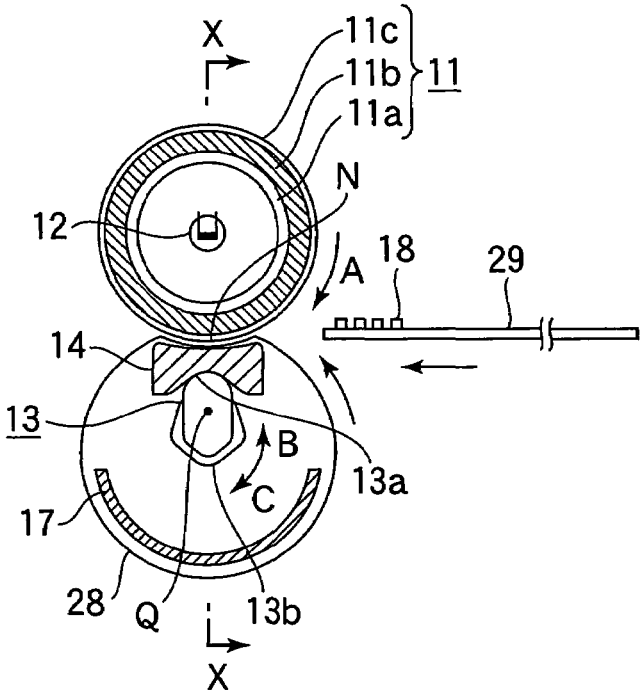
FIG. 1A is a cross-sectional view of a fixing unit according to a first embodiment.

FIG. 1A is a cross-sectional view of a fixing unit according to a first embodiment.

FIG. 1B illustrates a partial expanded view of FIG. 1A.

Figure 2:
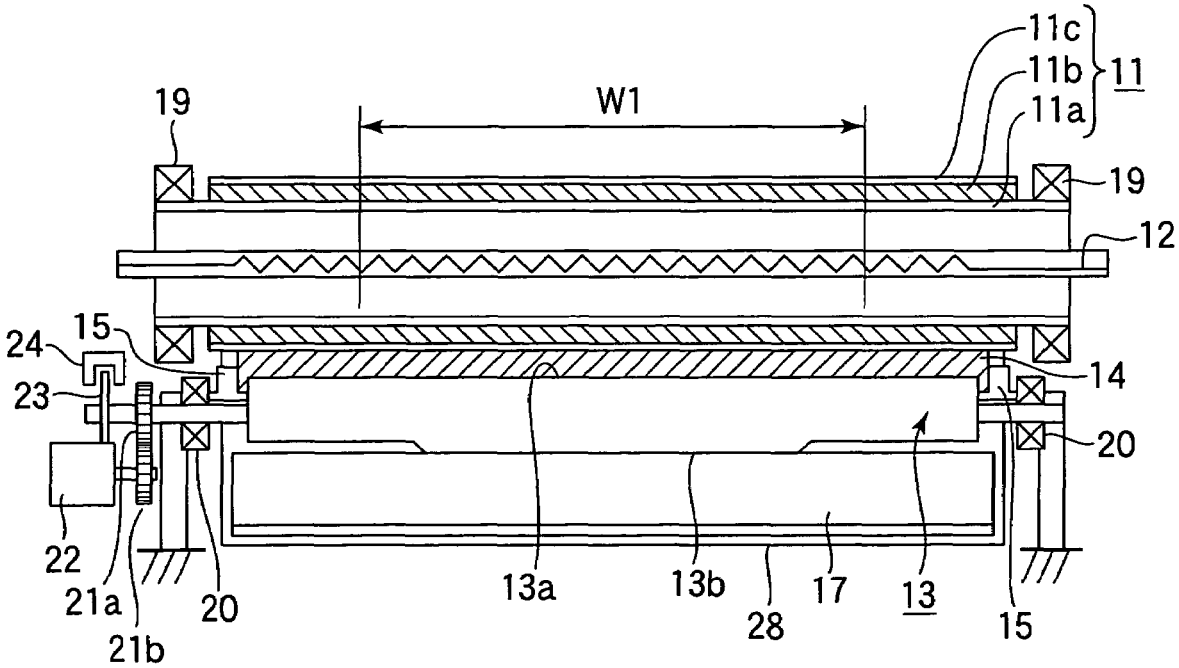
FIG. 2 is a cross-sectional view taken along line X-X of FIG. 1A.

FIG. 2 is a cross-sectional view taken along line X-X of FIG. 1A.

Referring to FIG. 1A, a heat roller 11 includes a core metal 11*a* with a resilient layer 11*b* formed on it and a coating layer 11*c* formed on the resilient layer 11*b*. The heat roller 11 incorporates a heater 12 as a built-in heater and is supported at opposite longitudinal end portions by bearings 19. A controller 26 (FIG. 3) performs a heating operation in which the heater 12 is energized to heat the heat roller 11 to a predetermined temperature. Then, the controller 26 drives a motor 22 (FIG. 3) that drives the fixing unit, thereby causing the heat roller 11 to rotate at a predetermined speed. A thermistor, not shown, is in contact with the outer circumferential surface of the heat roller 11 to detect the temperature of the circumferential surface.

FIG. 1B is an enlarged view of a pertinent portion of FIG. 1A.

Figure 5:
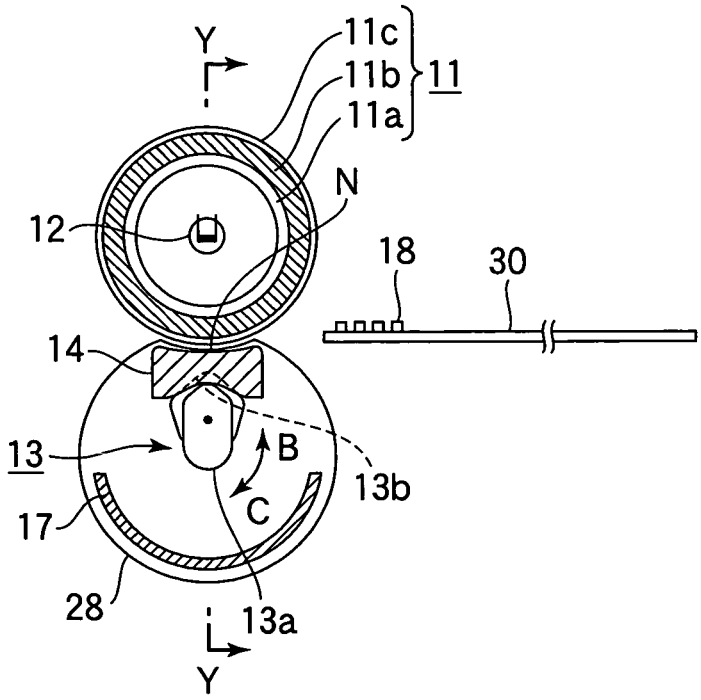
FIG. 5 is a cross-sectional view of the fixing unit according to the first embodiment.

A cam 13 is disposed under a pressure pad 14 and rotatably supported on bearings 20. The cam 13 is rotatable about an axis Q in directions shown by arrows B and C. The cam 13 has a cam surface 13*a* that applies pressure against the pressure pad 14 when the cam surface engages the pressure pad 14 as shown in FIG. 1A. The cam surface has a radius of curvature r as shown in FIG. 1B. The cam 13 also has another cam surface 13*b* that applies pressure against the pressure pad 14 when the cam surface 13*b* engages the pressure pad 14 as shown in FIG. 5. The cam surface 13*b* are at diametrically opposite side of the cam 13 from the cam surface 13*a*. The cam surfaces 13*a* and 13*b* extend in their longitudinal direction and in their circumferential direction. The cam 13 is designed to have distances a, b, and c such that $a<b<c$.

The cam 13 has one end to which a circular light-blocking disk 23 is attached. The circular light-blocking disk has a slit 23*a* (FIG. 3) formed in its circumferential peripheral portion. The light-blocking disk 23 is disposed in such a way that when the light blocking disk 23 rotates, the slit 23*a* rotates into and out of a light path of a position detector 24.

The cam 13 has a gear 21*a* mounted near the light-blocking plate 23 that is in mesh with a gear 21*b*. The gear 21*b* is mounted on a shaft of a pulse motor 22. The rotation of the pulse motor 22 is transmitted to the cam 13 via a gear train formed of the gears 21*a* and 21*b*.

The pressure pad 14 is made of a resilient, heat-resistive material. The pressure pad 14 opposes the heat roller 11 and extends in a direction parallel to the longitudinal axis of the heat roller 11. When no pressure is exerted on the pressure pad 14, the pressure pad 14 has a rectangular cross-section. When the cam 13 rotates to a position shown in FIG. 1A, the cam surface applies a predetermined pressing force to the pressure pad 14 and the pressure pad 14 is resiliently deformed accordingly as shown in FIG. 1A, thereby transmitting the pressing force to the heat roller 11. Supporting members 15 on a body of the printer firmly support the pressure pad 14 at longitudinal ends of the pressure pad 14.

A belt guide 17 has an arcuate cross section and is disposed under the pressure pad 14. A fixing belt 28 is an endless belt and forms a nip N (i.e., fixing region) between the fixing belt 28 and the heat roller 11. The fixing belt 28 runs in a loop-like path, which surrounds the pressure pad 14, can shaft 13, and belt guide 17 and passes between the heat roller 11 and the pressure pad 14. Thus, the pressure pad 14 presses the heat roller 11 with the fixing belt 28 sandwiched therebetween. The pressure pad 14, cam 13, belt guide 17 and fixing belt 28 form a fixing unit.

The pressure pad 14 receives a pressing force from the cam 13 to press the fixing belt 28 against the heat roller 11, thereby creating a nip N between the heat roller 11 and the fixing belt 28. The nip forms a fixing region through which a recording medium passes for fixing.

When the heat roller 11 rotates in a direction shown by arrow A, the friction between the heat roller 11 and fixing belt 28 causes the fixing belt 28 to run in the loop-like path, so that the recording medium 29 such as paper and transparency is transported through the nip N.

The pressure pad 14 is deformed by a pressing force such that the nip N is an arcuate recess formed therein that faces the heat roller 11. Alternatively, the pressure pad 14 may have a pre-shaped arcuate recess configured to the outer circumferential surface of the heat roller 11. The pre-shaped arcuate recess provides a reliable shape of the nip N.

The operation of the aforementioned configuration of the fixing unit will be described. It is assumed that color printing is performed on a recording medium in the form of a cut-sheet having a width W and a uniform thickness.

When a host computer, not shown, such as a personal computer issues a print command to the printer, a paper-feeding section, not shown, feeds the recording medium 29 from a paper cassette. The recording medium 29 is then advanced by feeding rollers, not shown, through yellow, magenta, cyan, and black image-forming sections, not shown, in sequence.

Each image-forming section receives image data of a corresponding color from the host apparatus and forms a toner image of the corresponding color. As the recording medium 29 advances through the respective image-forming sections, the toner images of corresponding colors are transferred onto the recording medium 29 one over the other in sequence, creating a full-color toner image.

The following operations are performed at the same time as the image-forming processes at the respective image-forming sections.

The cam 13 is positioned so that the cam surface 13*a* or 13*b* applies a minimum sufficient pressing force to the pressure pad 14. A minimum sufficient pressing force is applied to the pressure pad 14, thereby preventing permanent deformation and deterioration of the heat roller 11 and pressure pad 14 due to the heat received from the heater 12 and the pressure applied through the pressure pad 14.

Figure 3:
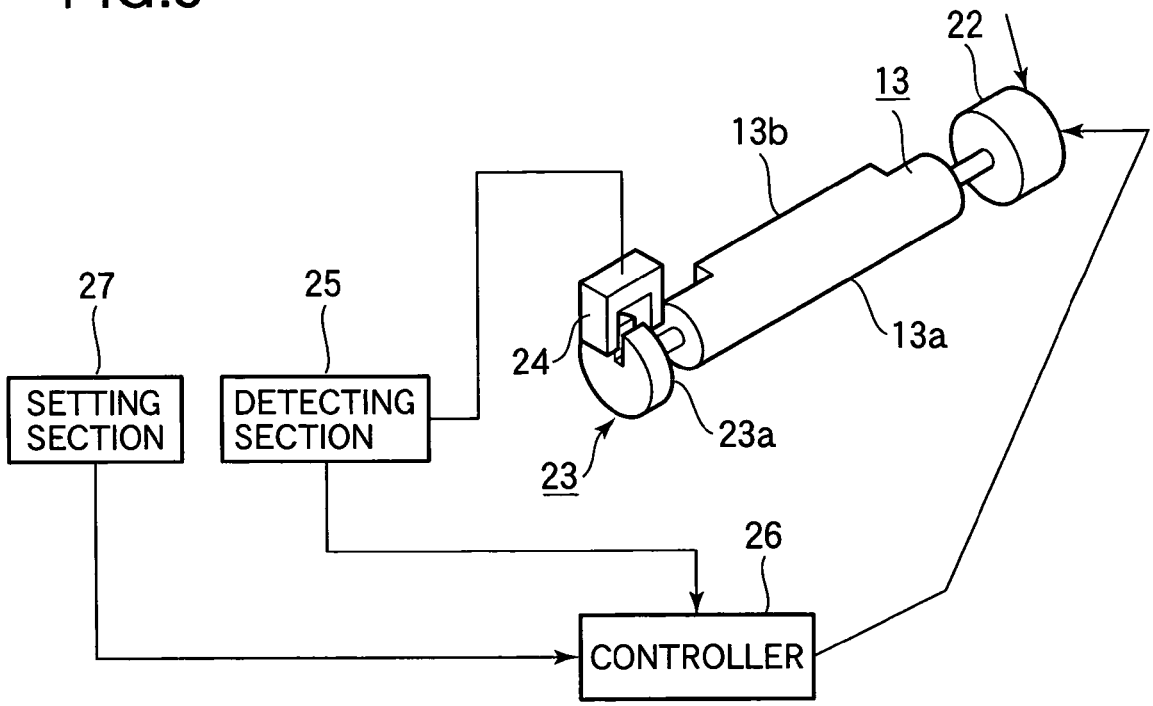
FIG. 3 is a schematic perspective view illustrating a nip-adjusting unit according to the first embodiment.

FIG. 3 is a schematic perspective view illustrating a nip-adjusting unit according to the first embodiment.

A setting section 27 stores the number of pulses that are used to drive the pulse motor 22 to rotate. The controller 26 drives the pulse motor 22 in rotation so that when the slit 23*a* enters the light path of the position detector 24, the position detector 24 generates a sensor output. The sensor output is sent to a detector 25. The detector 25 provides a detection signal to the controller 26, the detection signal indicating that the cam 13 is at a predetermined reference position (FIG. 3). Upon the detection of the slit 23*a*, the controller 26 causes the pulse motor 22 to stop at the predetermined reference position where the cam 13 exerts the smallest pressure on the pressure pad 14.

Then, the controller 26 performs a pressure distribution adjusting operation. In other words, the controller 26 supplies a predetermined number of pulses to the pulse motor 22 and the pulse motor 22 drives the cam 13 to rotate through an angle corresponding to the number of pulses specified from the setting section 27. Thus, a predetermined profile of distribution of pressing force can be set across the length of the heat roller 11 by means of the cam surfaces 13*a* and 13*b*. Upon receiving the print command from the host apparatus, the heater 12 begins to heat the heat roller 11.

When the printer receives information on the recording medium 29 such as size, thickness, shape, and material, the controller 26 provides a predetermined number of pulses to the pulse motor 22. In accordance with the predetermined number of pulses, the pulse motor rotates the cam 13 from the reference rotational position to a rotational position shown in FIGS. 1 and 2. Thus, the cam surface 13*a* of the cam 13 applies a pressing force to the pressure pad 14, thereby transmitting a pressing force to the heat roller 11 with a desired profile of distribution across the length of the cam 13. When printing is performed on ordinary paper, the position of the cam 13 is at the angular position in FIGS. 1 and 2. This angular position of the cam 13 is referred to as "ORDINARY PAPER position" in the present embodiment.

When the surface temperature of the heat roller 11 detected by the thermistor reaches a predetermined value, the controller 26 drives the motor to rotate the heat roller 11 at a predetermined rotational speed, so that the fixing belt 28 runs to maintain the entire surfaces of the heat roller 11 and fixing belt 28 at a uniform temperature.

The cam 13 is rotated before the heat roller 11 begins to rotate so that the nip is created concurrently with the image-forming processes of the respective image-forming sections. This operation not only shortens the time required for printing but also transmits a pressing force to the heat roller 11, the pressing force having the same profile of distribution as in an actual fixing operation. This operation allows preheating of the heat roller 11 and fixing belt 28 to a stable, high temperature at the nip N. The cam 13 can be rotated to create an appropriate nip N at any timing before the recording medium 29 reaches the nip N.

When the recording medium 29 having a toner image 18 thereon enters the nip N, the toner image 18 is heated at a predetermined temperature so that the toner image 18 is fused into the recording medium 29 under an appropriate pressure.

Figure 4:
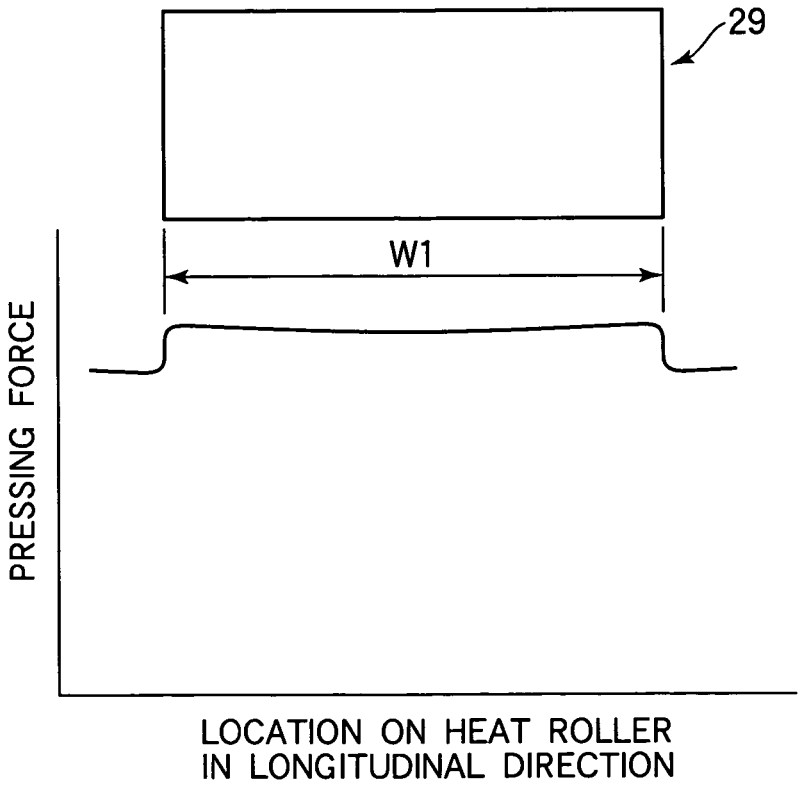
FIG. 4 illustrates the relation between the axial length of a heat roller and the pressure exerted on the heat roller.

FIG. 4 illustrates the relation between the axial length of a heat roller and the pressure exerted on the heat roller.

If the recording medium 29 is ordinary paper, the pressing force exerted on the heat roller 11 is substantially uniform across the entire length of the heat roller 11 as shown in FIG. 4. This ensures reliable fixing results. The pressing force in FIG. 4 is exerted on the entire width of the nip N.

The operation will be described when a recording medium is, for example, an envelope bonded at the same locations and having the same width W but different thicknesses at different locations. Such a recording medium can be fixed reliably. Elements having similar configurations as those in FIGS. 1 and 2 have been given the same reference numerals, and the description thereof is omitted.

FIG. 5 is a cross-sectional view of the fixing unit according to the first embodiment.

Figure 6:
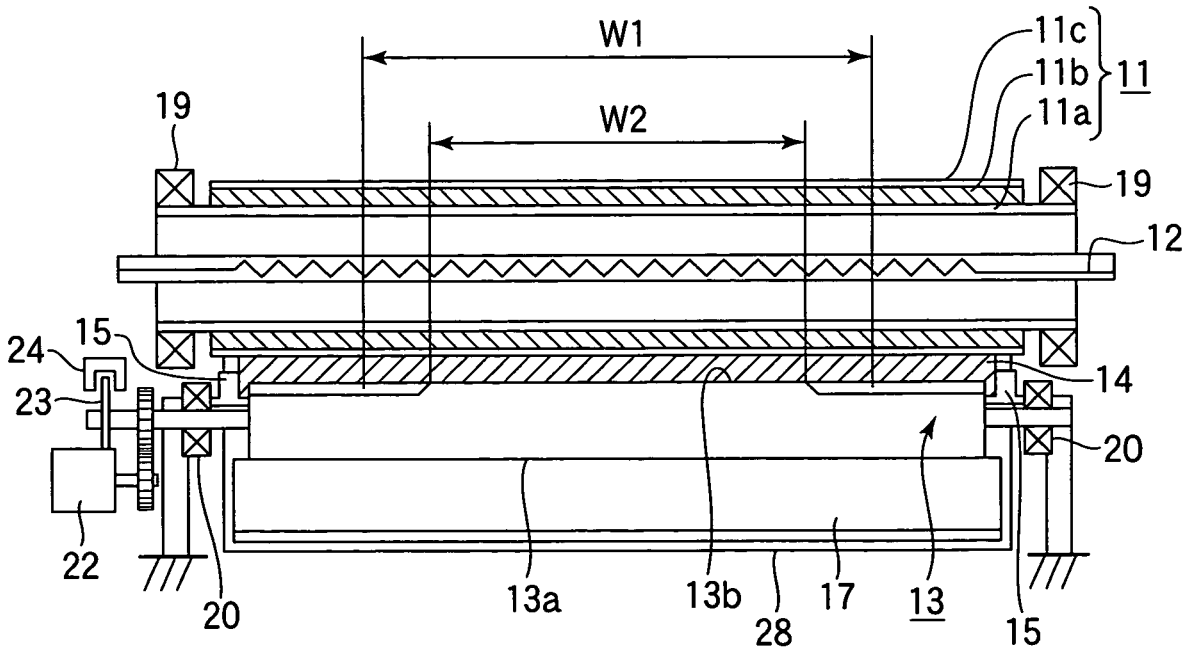
FIG. 6 is a cross-sectional view taken along line Y-Y of FIG. 5.

FIG. 6 is a cross-sectional view taken along line Y-Y of FIG. 5.

Upon a print command from the host apparatus, the heater 12 begins to heat the heat roller 11. If a recording medium 30 is an envelope, the recording medium 30 differs from the recording medium 29 in thickness and crease-resistance. Thus, experiment was conducted for different types of recording medium to investigate the relation between the types of recording medium and corresponding fixing temperatures required. The relation is listed in Table 1.

TABLE 1

| TYPE OF MEDIUM | TEMPERATURE (° C.) | DISTRIBUTION OF PRESSING FORCE ACROSS HEAT ROLLER |
|---|---|---|
| THIN PAPER | 164 | UNIFORM |
| THICK PAPER | 170 | UNIFORM |
| SLIGHTLY THICK PAPER | 182 | UNIFORM |
| THICK PAPER | 185 | UNIFORM |
| ENVELOPE #1 | 164 | HIGH IN THE MIDDLE |
| ENVELOPE #2 | 174 | HIGH IN THE MIDDLE |
| OHP #1 | 162 | UNIFORM |
| OHP #2 | 164 | UNIFORM |

When the printer receives information on a recording medium such as size, thickness, shape, and material, the controller provides a predetermined number of pulses to the pulse motor 22. Then, in accordance with the predetermined number of pulses, the pulse motor rotates the cam 13 from the reference rotational position to a rotational position shown in FIGS. 5 and 6.

Figure 7:
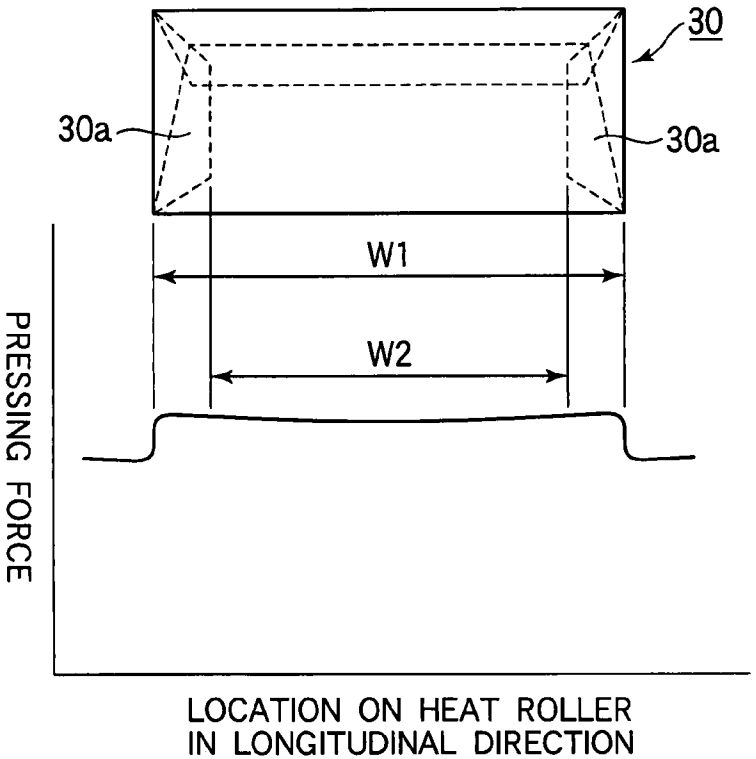
FIG. 7 illustrates the relation between the pressing force and the location of the nip in the longitudinal direction of the nip.

FIG. 7 illustrates the relation between the pressing force and the location of the nip in the longitudinal direction of the nip. The pressing force in FIG. 7 is exerted on the entire width of the nip N. Because the envelope has folded and bonded portions 30*a*, the recording medium 30 is thicker at the bonded portions 30*a* than at an area surrounded by the bonded portions 30*a*. For this reason, the cam surface 13*a* is further away from its rotational axis at an area between the bonded portions 30*a* than at the bonded portions 30*a*. That is, the width W' is smaller than the width W of the recording medium 30. Therefore, when the cam 13 is at the rotational position shown in FIGS. 5 and 6, the middle portion W' of the cam surface 13*b* applies a larger pressing force to the pressure pad 14 than the rest of the cam surface 13*b*. This configuration provides a uniform pressing force across the length of the cam 13 in FIG. 6, ensuring a good fixing operation across the entire width of the recording medium 30. This angular position of the cam 13 at which best printing can be performed for envelopes is referred to as "ENVELOPE position" in this specification.

As described above, when different types of recording media are to be printed, pressing forces can be distributed appropriately across the pressure pad 14 so that the uniform nip N can be formed to improve print quality.

It is only necessary to rotate the cam 13 for setting the profile of distribution of pressing force in the longitudinal direction of the nip N. For achieving a desired profile of pressure distribution across the length of heating roller 11, there is no need for selecting different combinations of, for example, pressurizing springs or precisely adjusting relative positions between the fixing unit and the body of the printer. Thus, the configuration prevents variations of pressing force across the length of the heat roller 11.

Figure 8:
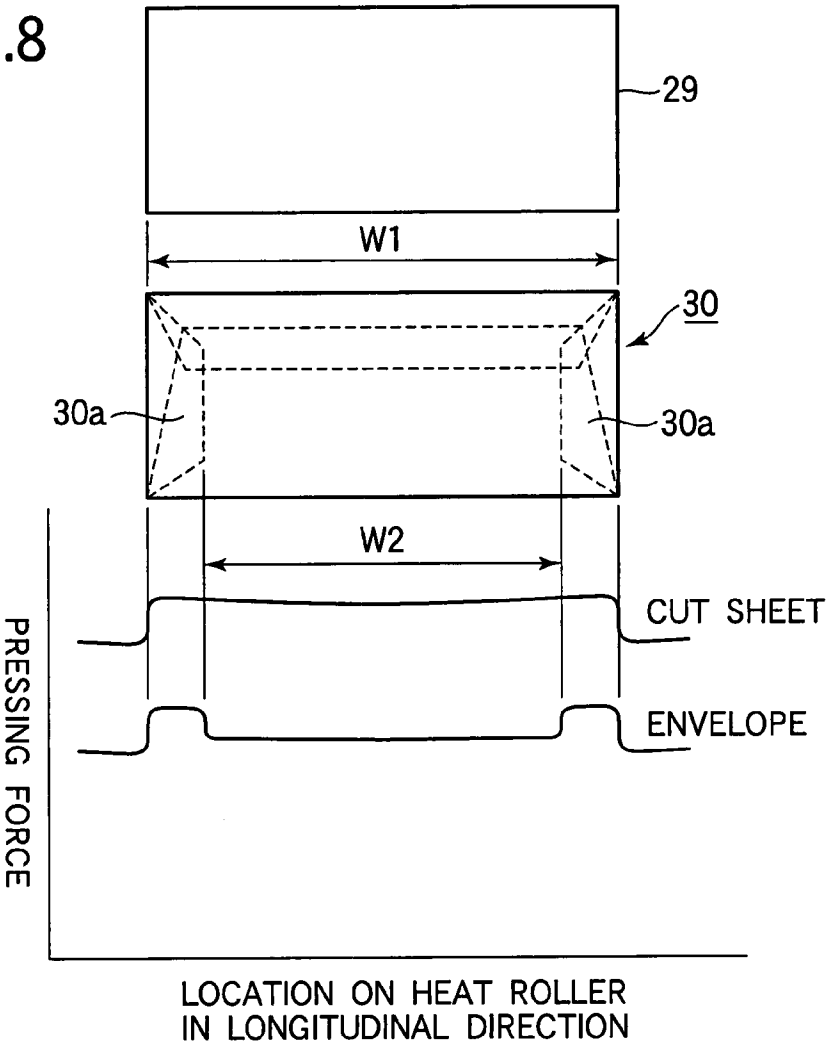
FIG. 8 is a graph of the prior art, illustrating the pressing force versus the location of nip in the longitudinal direction of heating roller.

FIG. 8 is a graph of the prior art, illustrating the pressing force versus the location of nip in the longitudinal direction of heating roller 11. The pressing force in FIG. 4 is exerted on the entire width of the nip N.

In the conventional fixing apparatus, when the recording medium 29 such as cut-sheets is used, a uniform pressing force can be applied across the width W of the recording medium 29 as shown in FIG. 8. However, if fixing is to be performed on an envelope, the nip N is formed in accordance with the thickness of the bonded portions 30*a* of the recording medium 30. As a result, the pressing force is larger at the bonded portions 30*a* than at an area bounded between the bonded portions 30*a*. This is detrimental to good fixing results.

The configuration of the present embodiment eliminates the need for the heat roller 11 having a large diameter and the coating 11*c* having a large thickness, so that the printer need not be large in overall size and the heat roller 11 need not be large in heat capacity. This leads to saving of electric power.

The cam surfaces 13*a* and 13*b* need not be diametrically opposite but may be angularly spaced by, for example, 90 degrees.

While the cam 13 is positioned selectively at the ORDINARY PAPER position and the ENVELOPE position in the first embodiment, the cam 13 is not limited to this configuration. The cam 13 may have additional rotational positions such as "release position" at which no pressing force is applied to the heat roller 11, "THICK PAPER position" at which fixing is performed on a recording medium having a large thickness, and "THIN PAPER position" at fixing is performed on a recording medium having a small thickness.

While the recording medium 30 has been described with respect to an envelope having non-uniform thickness across its width, the recording medium 30 may take other forms such as label paper and transparency.

The above-described configuration provides a uniform distribution of pressing force for a recording medium having a surface that is partially coated and therefore has a non-uniform thickness across its surface.

Second Embodiment

Elements similar to those in the first embodiment have been given the same reference numerals and the description thereof is omitted.

Figure 9:
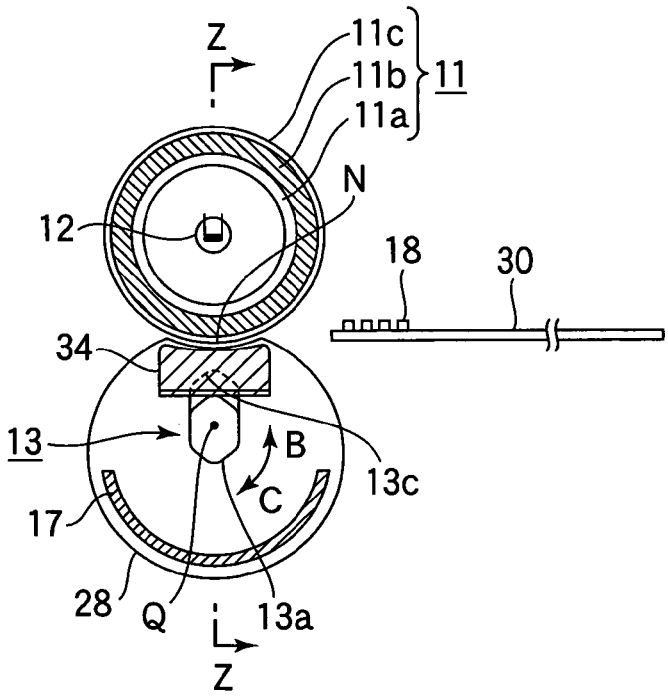
FIG. 9 is a cross sectional view of a fixing unit according to a second embodiment.

FIG. 9 is a cross sectional view of a fixing unit according to a second embodiment.

Figure 10:
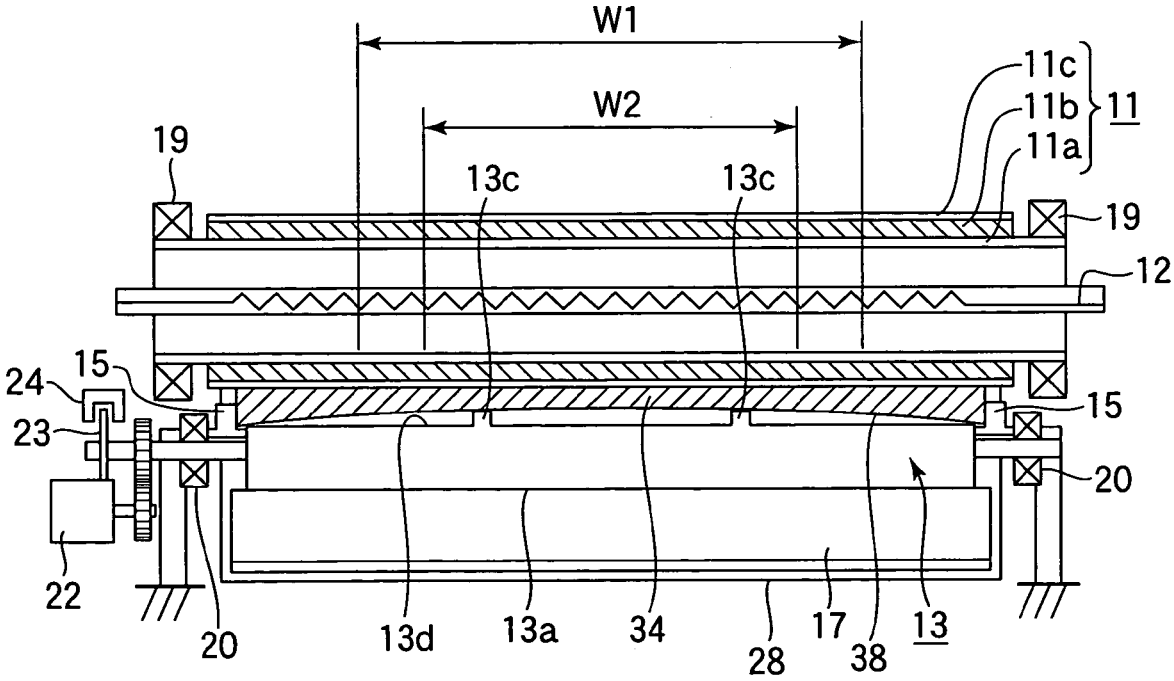
FIG. 10 is a cross-sectional view taken along line Z-Z of FIG. 9.

FIG. 10 is a cross-sectional view taken along line Z-Z of FIG. 9.

A pad plate 38 is disposed on the opposite side of a pressure pad 34 from an arcuate recess. The pad plate 38 extends in a longitudinal direction and is made of a thin plate of SUS, which is resiliently deformable in a direction parallel to the longitudinal axis of the pressure pad 14. Supporting members 15 on a body of printer firmly supports the pressure pad 34 and pad plate 38 in place.

A cam 13 is rotatably supported on bearings 20 under the pressure pad 34. The cam 13 has a circumferential cam surface 13*a* having a predetermined radius with respect to a rotational axis of the cam 13. The cam 13 also has a surface 13*d* on the diametrically opposite side of the cam 13 from the cam surface 13*a*. The cam surface 13*d* has short projections 13*c* that radially outwardly project from the cam surface 13*d* and extend in a circumferential direction. The projections 13*c* are located within the width W' and a predetermined distance away from the surface 13*d*. The projections 13*c* serve to adjust the profile of distribution of the pressing force that acts on the pressure pad 34.

When fixing is performed on the recording medium 29, i.e., a cut-sheet having a uniform thickness, the controller 26 provides a predetermined number of pulses to the pulse motor 22, thereby positioning the cam 13 at the ORDINARY PAPER position. In other words, the cam surface 13*a* is brought into contact with the pressure pad 34.

When fixing is performed on the recording medium 30, i.e., an envelope having a non-uniform thickness in the width direction, the controller 26 provides a predetermined number of pulses to the pulse motor 22, thereby positioning the cam 13 at the ENVELOPE position in FIG. 9 and FIG. 10.

The projections 13*c* push the pad plate 38, causing the pad plate 38 and pressure pad 34 to deform so that the pad plate 38 and pressure pad 34 have an arcuate surface. The pad plate 38 and pressure pad 34 are deformed such that the arcuate surface is further away from the cam surface 13*d* nearer the longitudinal center of the cam 13. Thus, deformation of the pad plate 38 and pressure pad 34 presses a fixing belt 28 against the heat roller 11.

The above-described configuration allows the pressing force to be larger at an area between the bonded portions 30*a* than at the bonded portions 30*a*. Thus, the pressing force is distributed more uniformly across the width of the recording medium when the projections 13*c* are employed than when the projections 13*c* are not employed, so that fixing is performed reliably across the width W of the recording medium 30.

In the present embodiment, the pad plate 38 is arranged between the pressure pad 34 and the cam 13 to adjust an amount of deformation of the pressure pad 34. Therefore, a desired nip region N can be obtained without having to use the cam 13 with a complicated shape. This reduces the manufacturing cost of the fixing unit.

Because each of the projections 13*c* can be small, a plurality of projections 13*c* may be provided on the cam surface 13*d* of the cam 13. Thus, the pressing force can be distributed properly in accordance with the types of recording medium.

Figure 11:
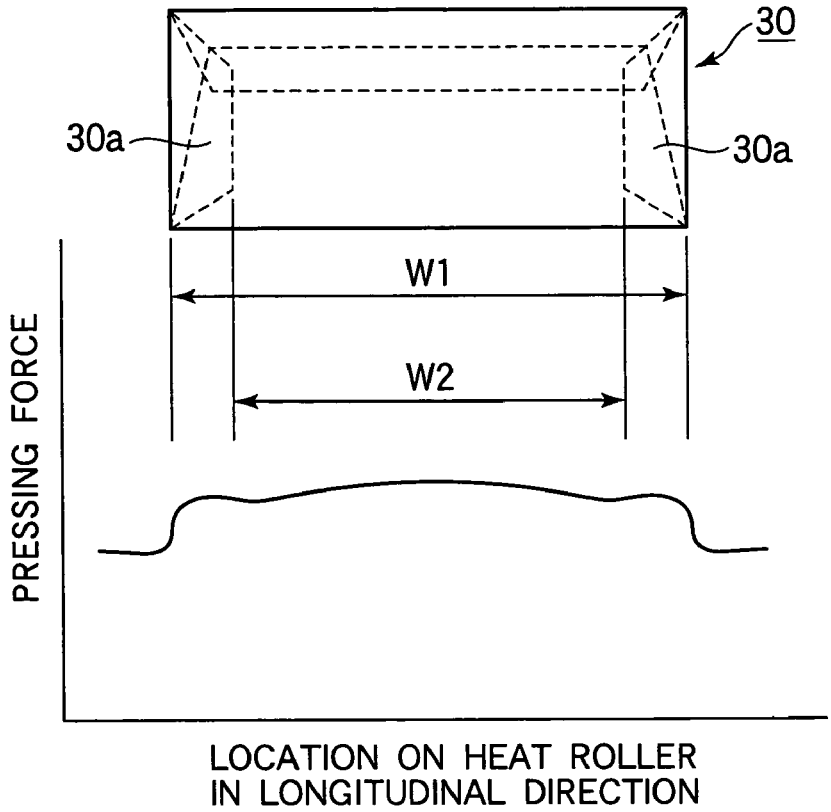
FIG. 11 illustrates the relation between the pressing force and between the location of the nip in the longitudinal direction of the nip.

FIG. 11 illustrates the relation between the pressing force and between the location of the nip in the longitudinal direction of the nip. The use of the resiliency of the pad plate 38 provides the smoothly varying distribution of the pressing force, so that fixing can be efficiently performed on the ordinary paper having a uniform thickness across its width as shown in FIG. 11.

Third Embodiment

Elements similar to those in the second embodiment have been given the same reference numerals and the description thereof is omitted.

Figure 16:
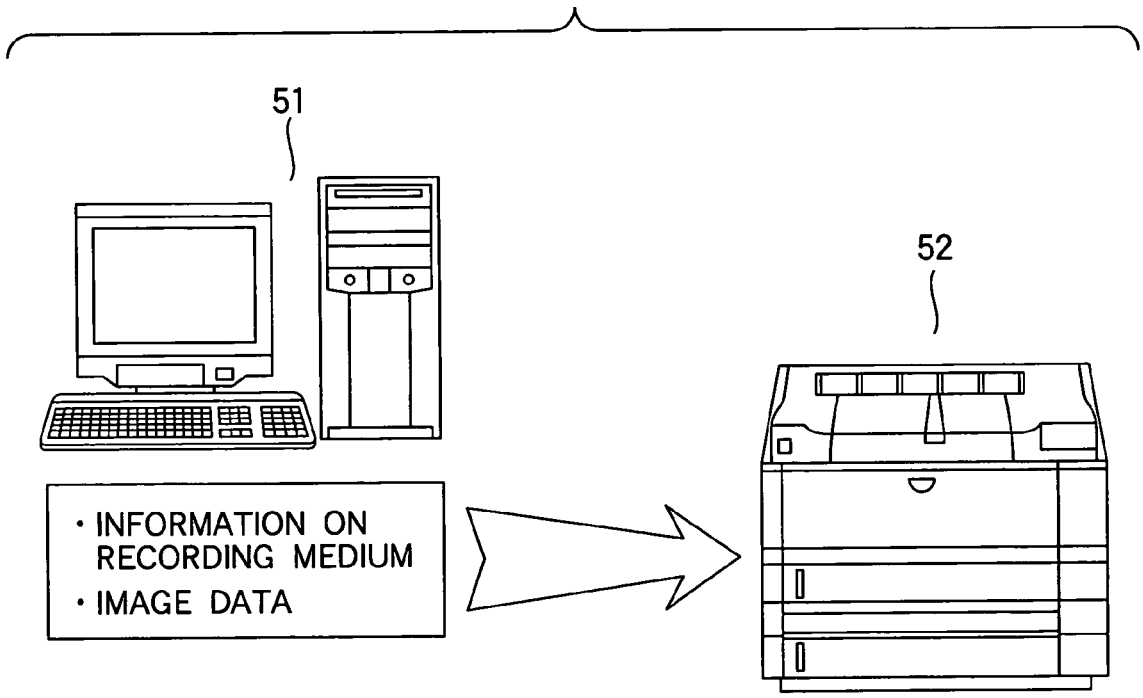
FIG. 16 illustrates a printer system according to the third embodiment.

FIG. 16 illustrates a printer system according to the third embodiment. Referring to FIG. 16, a host apparatus 51 sends image data together with information on the recording medium. The information includes thickness, shape, and material to a printer 52.

Figure 12:
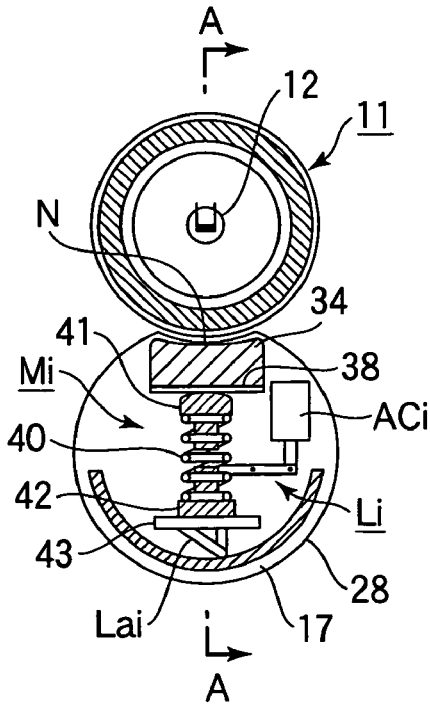
FIG. 12 is a cross-sectional view of a fixing unit according to a third embodiment.

FIG. 12 is a cross-sectional view of a fixing unit according to a third embodiment.

Figure 13:
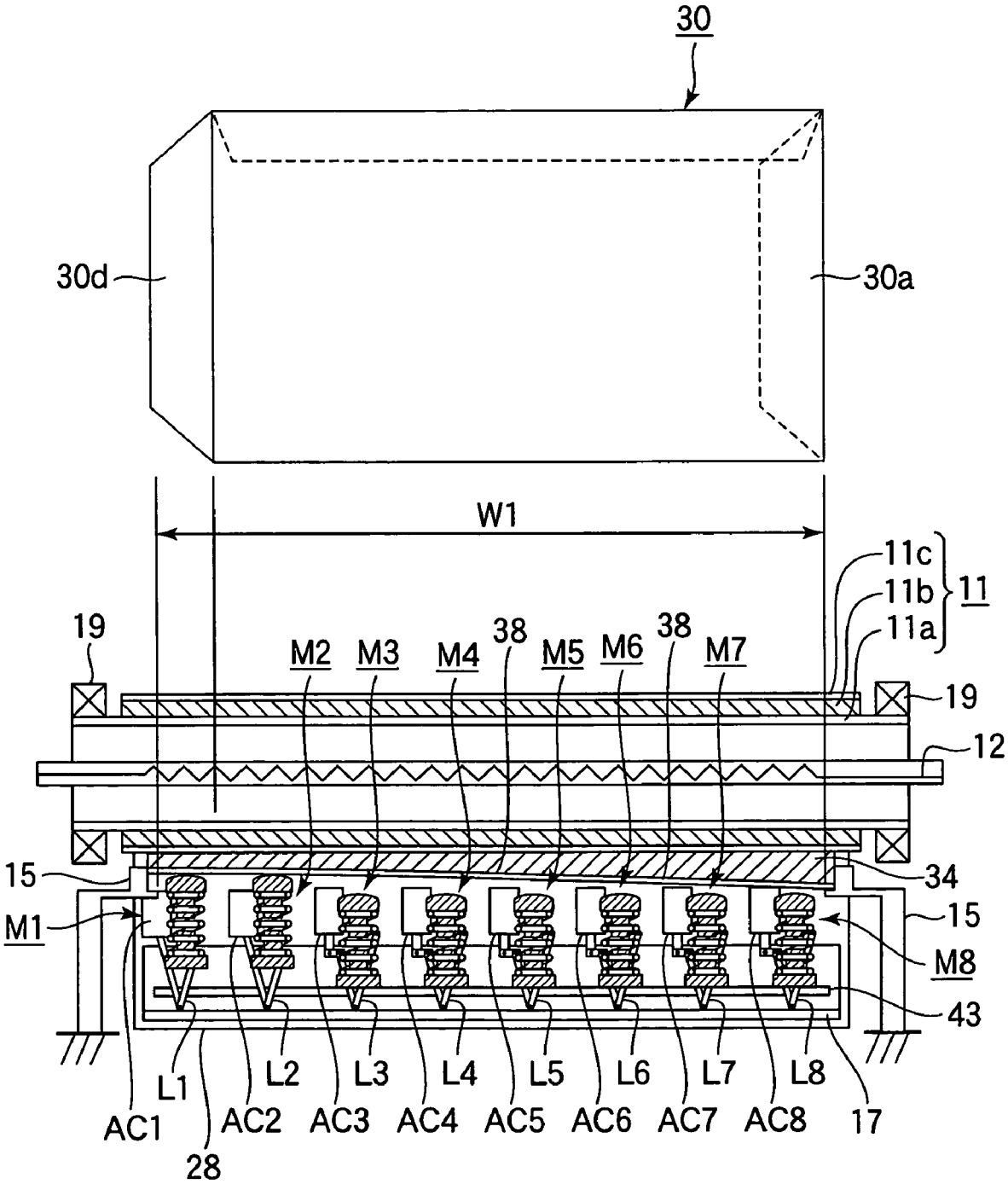
FIG. 13 is a cross-sectional view taken along line A-A of FIG. 12.

FIG. 13 is a cross-sectional view taken along line A-A of FIG. 12.

A pad plate 38 is disposed on the underside of the pressure pad 34 (i.e., on the opposite side of the pressure pad 34 from an arcuate recess that faces the heat roller 11). There are provided a plurality of sub-mechanisms M1-M8 that are supported on a supporting member 43 and aligned in a line under the pad plate 38. Each of the plurality of sub-mechanisms M1-M8 includes an electromagnetic actuator ACi (i=1, 2, 3, . . . , 8) and a link mechanism Li (i=1, 2, 3, . . . , 8) and operates independently of the other sub-mechanisms to press the pressure pad 34.

The sub-mechanisms M1-M8 are identical. For simplicity, only the operation of the pressing mechanism M1 will be described, it being understood that the other sub-mechanisms M2-M8 work in a similar fashion. The pressing mechanism M1 includes a compression spring 40, a pressing pin 41 attached to an upper end of the compression spring 40, and a spring post 42 that is fixed to the supporting member 43 and supports the lower end portion of the compression spring 40. The link mechanism L1 includes a link Lb that pivots about a pin 44. The link Lb has one end coupled to a movable portion of the electromagnetic actuator AC1 and another end to a link Lc, which in turn is pivotally connected to a link La. The links Lc and La extend through opening 46. The actuator AC and the pins 44 and 45 are mounted on the supporting member 43.

Figure 14:
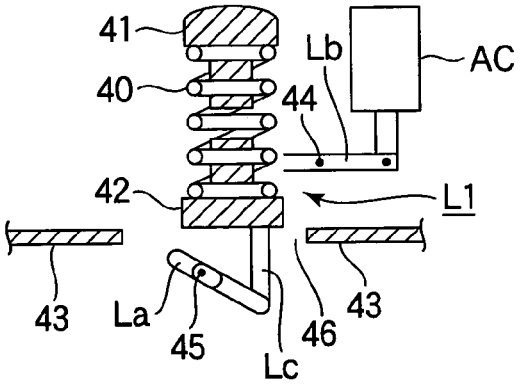
FIGS. 14 and 15 illustrate the operation of a pressing mechanism N1 according to the third embodiment.
Figure 15:
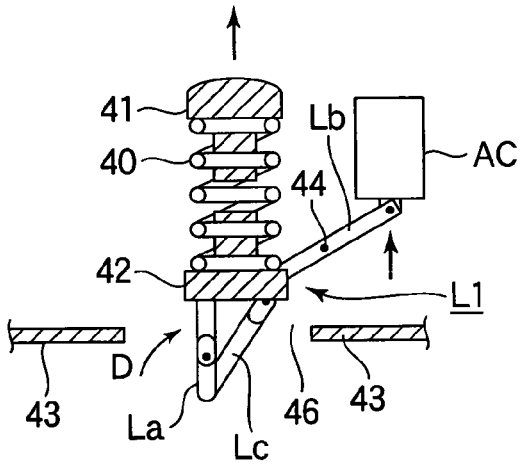

FIGS. 14 and 15 illustrate the operation of a pressing mechanism N1 according to the third embodiment.

When the electromagnetic actuator AC1 is not energized, the link La1 is away from the lower end of the spring post 42 as shown in FIG. 14, so that the pressing pin 41 is at its lower position not to push up the spring post 42. Thus, the pressing pin 41 does not apply a pressing force to the pad plate 38. When the electromagnetic actuator AC1 is energized, the movable portion is retracted into the electromagnetic actuator AC as shown in FIG. 15, so that the link La rotates in a direction shown by arrow D to its higher position to push up the spring post 42. Thus, the pressing pin 41 is at its upper position to apply a pressing force to the pad plate 38.

Thus, when the controller 26 causes appropriate ones of the electromagnetic actuators Acl-AC8 to operate, the corresponding links La pushes up the spring post 42, which in turn causes the pressing pin 41 to push up the pad plate 38.

In this manner, the pressing force is properly distributed across the entire width of the recording medium 30.

In the third embodiment, the eight sub-mechanisms M1-M8 are employed. Instead, a large number of sub-mechanisms having a miniaturized electromagnetic actuator and a link may be employed or a smaller number of sub-mechanisms having a simplified configuration may be employed depending on the type and shape of the recording medium.

While each sub-mechanism Mi is operated with corresponding electromagnetic actuator ACi and link Li, the sub-mechanism Mi may be operated with any mechanism provided that the sub-mechanisms can be operated independently.

The operation of the controller 26 will be described. The controller 26 reads the information on the recording medium received in a printer 52. Then, the controller 26 determines the type of recording medium and selects the position of the cam, i.e., an appropriate sub-mechanism in accordance with the type of recording medium. Then, a set of fixing temperature, printing speed, and pressing force is determined for the selected position.

If the recording medium is an envelope, the ENVELOPE position is selected. If the recording medium has a uniform but larger thickness than the envelope, the THICK PAPER position is selected. If the recording medium has a smaller thickness than the ordinary paper, the THIN PAPER position is selected. If the recording medium has a standard thickness, then the ORDINARY PAPER position is selected. Likewise, if the recording medium is transparency, a predetermined position may be selected in accordance with a predetermined profile of distribution of pressing force.

If the recording medium is a large size envelope as shown in FIG. 13 and the ENVELOPE position is selected, the controller 26 turns off the electromagnetic actuators AC3-AC8 upon selection of the ENVELOPE position and turns on the electromagnetic actuators AC1 and AC2. If the THICK PAPER position is selected, the controller 26 turns off the electromagnetic actuators AC1-AC8. If the THIN PAPER position is selected, the controller 26 turns on the electromagnetic actuators AC1-AC8. If the ORDINARY PAPER position is selected, the controller 26 turns off the electromagnetic actuators AC1, AC3-AC6, AC8 and turns on the electromagnetic actuators AC2 and AC7.

When a large size envelope as shown in FIG. 13 is used, the recording medium 30 has a bonded portion 30*a* at one widthwise end and at one longitudinal end of the envelope, and a flap 30*d* at another longitudinal end of the envelope. Thus, the recording medium 30 has a large thickness at the bonded portion 30*a* and a small thickness at the flap 30*d*. Thus, the sub-mechanisms M1 and M2, which correspond to the smaller thickness of the recording medium 30, are operated to press the pad plate 38 and pressure pad 34 as shown in FIG. 13, thereby adjusting the distribution of pressing force in accordance with the recording medium 30 for reliable fixing performance across the entire surface of the recording medium 30.

If the recording medium 30 is an envelope having bonded portions 30*a* such as ones in the first and second embodiments or an envelope having different sizes from those in the first and second embodiments, a plurality of ENVELOPE positions may be provided. Then, an appropriate one of the plurality of ENVELOPE positions may be selected according to the size of a specific envelope. Thus, an appropriate profile of the pressing force can be obtained across the length of the nip N.

As described above, operating arbitrary ones of the respective sub-mechanisms AC1-AC8 causes the pad plate 38 and pressure pad 34 to deform into a desired shape to provide an optimum profile of distribution of pressing force. Thus, the distribution of the pressing force can be reliably set in accordance with various types of recording medium and the image quality can be improved.

In addition, the distribution of the pressing force can be adjusted without replacing the sub-mechanism, thereby reducing the cost of the fixing unit.

Figure 17:
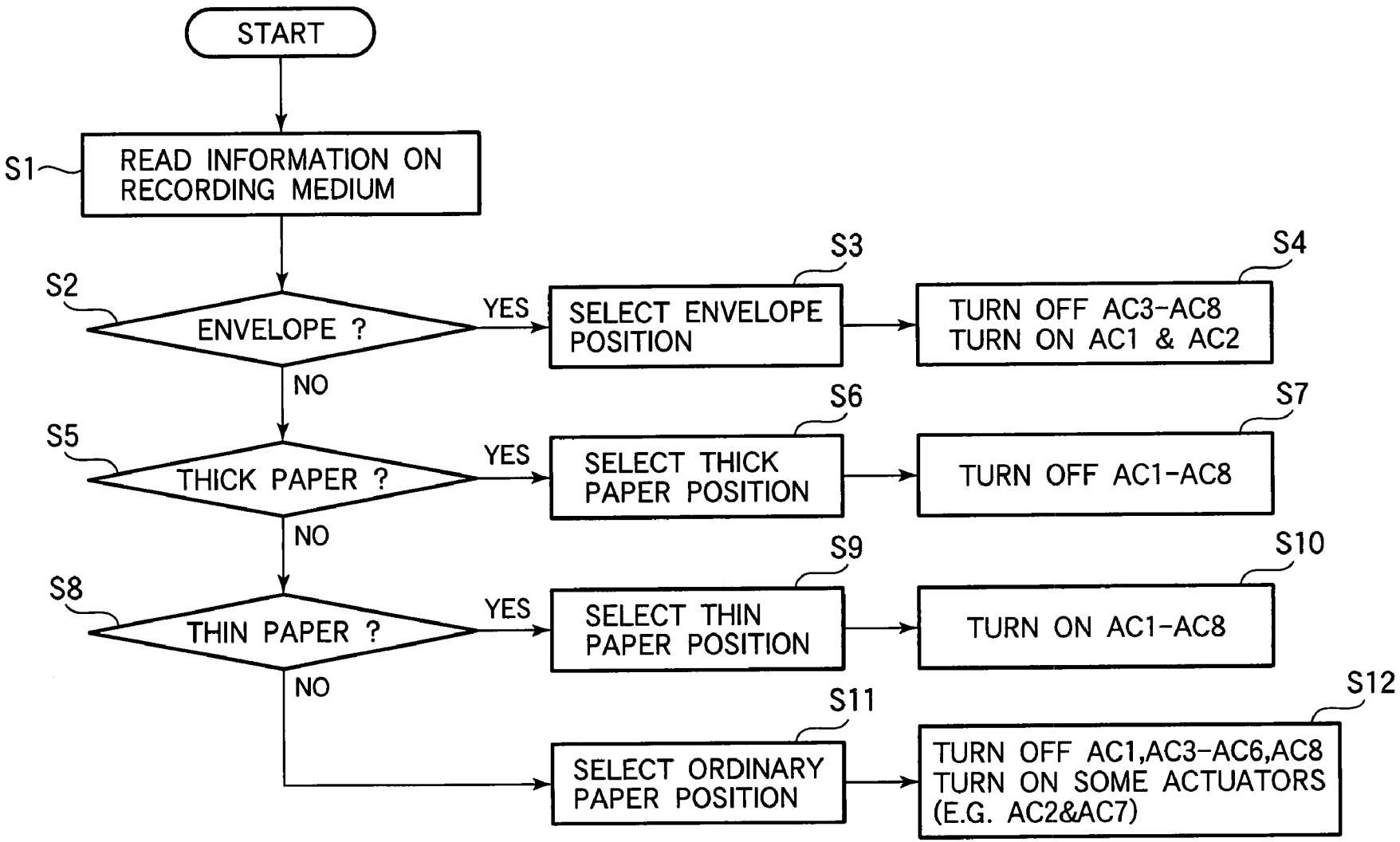
FIG. 17 is a flowchart illustrating the operation of the fixing unit according to the third embodiment.

FIG. 17 is a flowchart illustrating the operation of the fixing unit according to the third embodiment.

The flowchart will be described.

Step S1: The controller 26 reads the information on the recording medium accommodated in a printer 52.

Step S2: The controller 26 determines the type of the recording medium. If the recording medium is an envelope, the program proceeds to step S3. If NO, then the program proceeds to step S5.

Step S3: The controller 26 selects the ENVELOPE position.

Step S4: The controller turns off the electromagnetic actuators AC3-AC8 and turns on the electromagnetic actuators AC1 and AC2.

Step S5: A decision is made to determine whether the recording medium is thick paper. If YES, then the program proceeds to step S6 where the controller 26 selects the THICK PAPER position. If NO, the program proceeds to step S8.

Step S7: The controller 26 turns off the electromagnetic actuators AC1-AC8 off.

Step S8: A decision is made to determine whether the recording medium is thin paper. If YES, the program proceeds to step S9. If NO, the program proceeds to step S11.

Step S9: The controller 26 selects the THIN PAPER position.

Step S10: The controller 26 turns on the electromagnetic actuators AC1-AC8.

Step S11: The controller 26 selects the ORDINARY PAPER position.

Step S12: The controller turns off the electromagnetic actuators AC1, AC3-AC6, and AC8 and turns on the other few electromagnetic actuators, for example, A2 and A7.

In the present embodiment, when the ORDINARY PAPER position is selected, the electromagnetic actuators AC2 and AC7 are turned on. The present invention is not limited to this configuration, but may be configured such that the electromagnetic actuators AC are provided at several locations to set a smaller pressing force for thick paper but a larger pressing force for thin paper.

Fourth Embodiment

Elements similar to those in the third embodiment have been given the same reference numerals and the description thereof is omitted.

Figure 18:
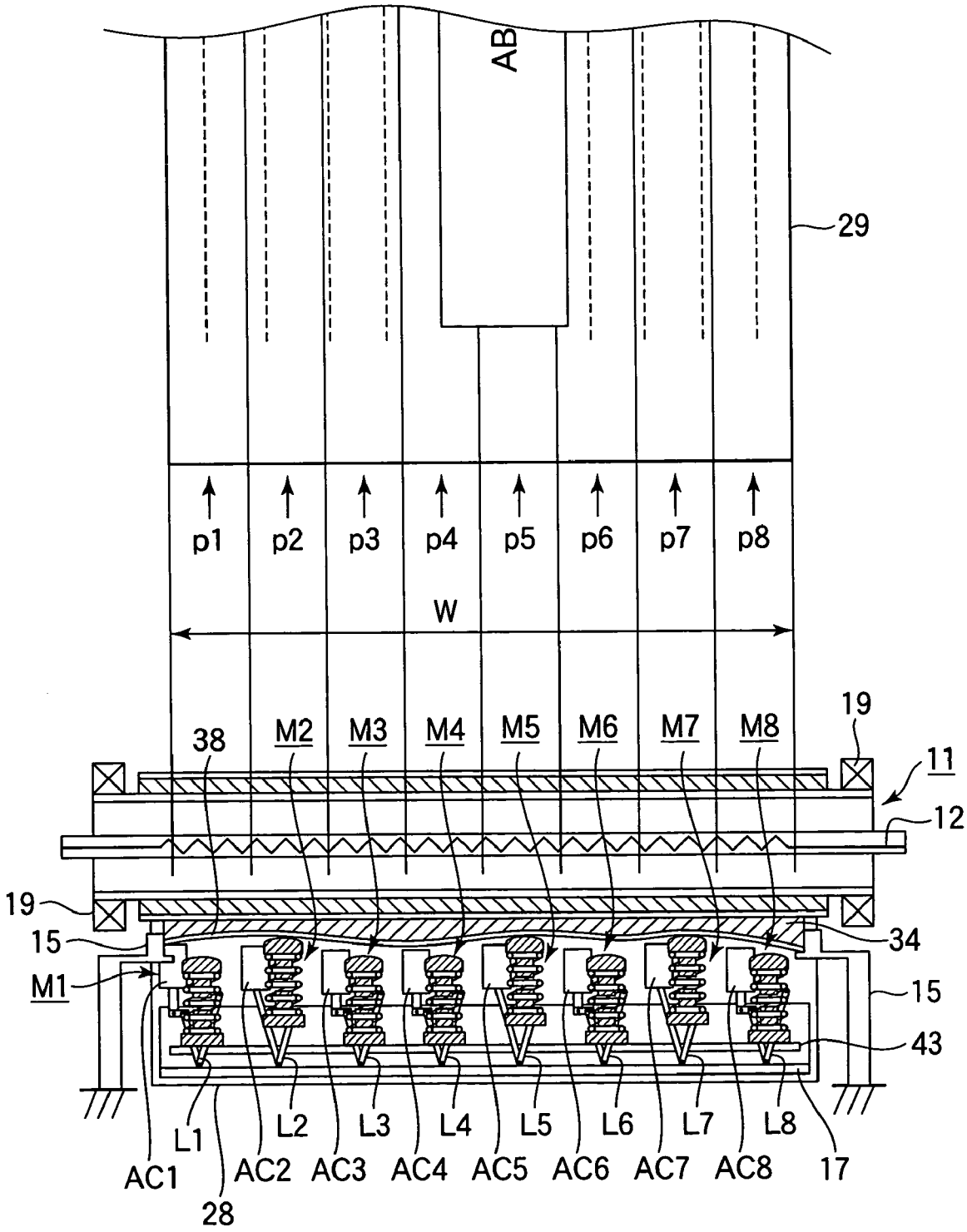
FIG. 18 is a cross-sectional view of a fixing unit according to a fourth embodiment.

FIG. 18 is a cross-sectional view of a fixing unit according to a fourth embodiment.

Figure 19:
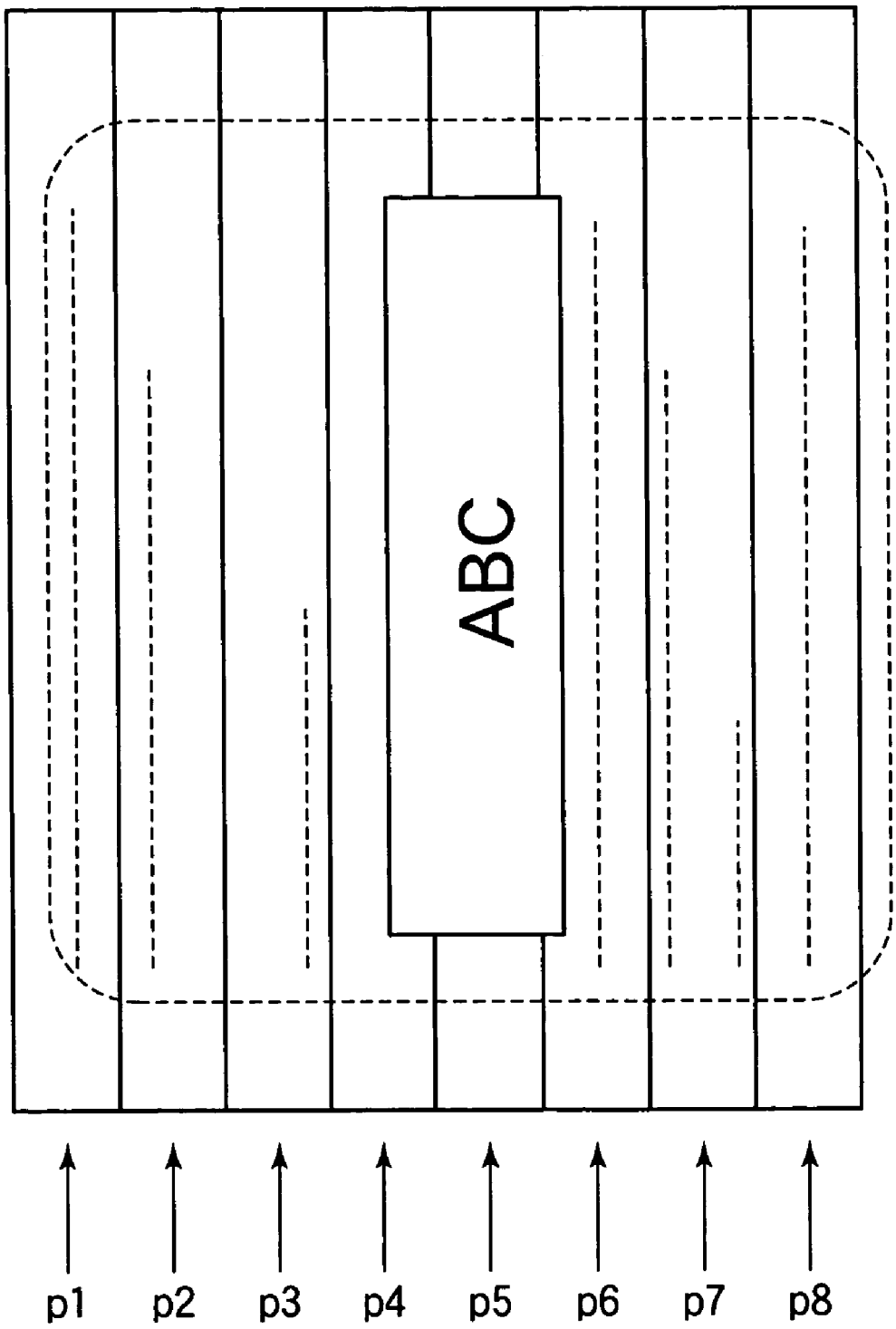
FIG. 19 illustrates image data according to the fourth embodiment.

FIG. 19 illustrates image data according to the fourth embodiment.

For graphic images, if the size of the image is large, or the print duty of the image is high due to the fact that image area represents a large percentage of the total area of the recording medium, particularly when a full color image is to be printed, a decrease in pressing force causes poor fixing such as "offset" that decreases image quality.

In order to solve this problem, the fourth embodiment employs eight sub-mechanisms M1-M8 that press eight different belt-shaped areas of the recording member, the eight different belt-shaped areas extending in parallel in the direction of travel of the recording medium. This configuration allows increasing of the pressing force for areas in which the image is printed at high print duty.

Upon determining the type of print medium, the controller 26 reads image data and makes a decision to determine a print duty based on the size of the image area of the image data, the ratio of an actual image area of the recording medium to the total available image area on the recording medium. Thus, the controller 26 determines whether an image to be printed contains a high print duty.

For example, as shown in FIGS. 18 and 19, if the recording medium 29 has areas P1-P8 and an area P5 is to be printed at a high print duty, the sub-mechanism M5 that corresponds to the area P5 presses the pad plate 38 and pressure pad 34.

If, for example, the ORDINARY PAPER position has been selected, the controller 26 turns on the electromagnetic actuator AC5 in addition to the electromagnetic actuators AC2 and AC7.

As described above, the distribution of pressing force can be set based on not only the information on the recording medium but also print duty of the image data, so that the image quality is further improved.

Figure 20:
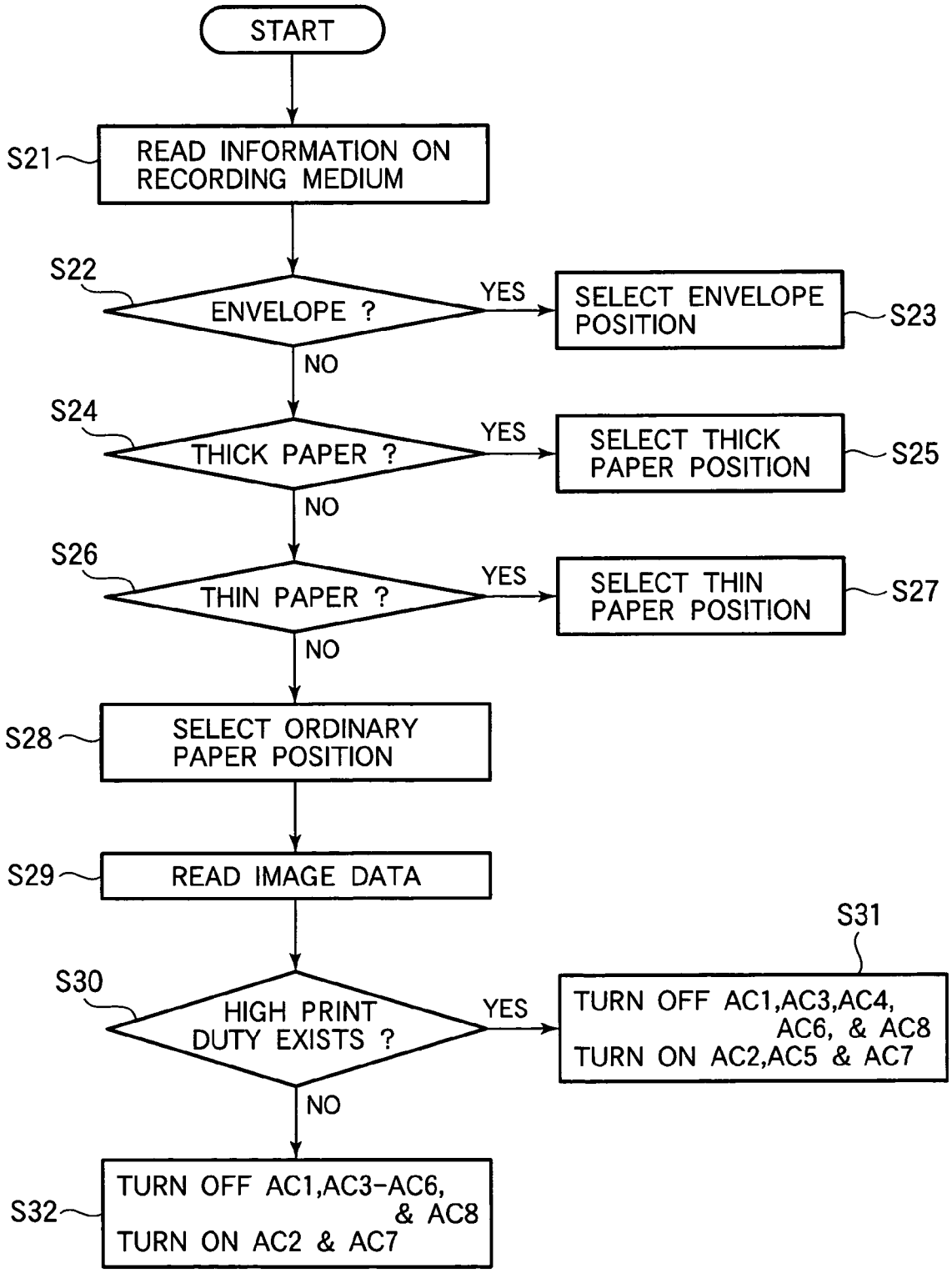
FIG. 20 is a flowchart illustrating the operation of the fourth embodiment.

FIG. 20 is a flowchart illustrating the operation of the fourth embodiment. The operation of the fourth embodiment will be described with reference to FIG. 20.

Step S21: The controller 26 reads information on the recording medium.

Step S22: The controller 26 makes a decision to determine whether the recording medium is an envelope. If YES, then the program proceeds to step S23. If NO, the program proceeds to Step S24.

Step S23: The controller 26 selects the ENVELOPE position.

Step S24: The controller 26 makes a decision to determine whether the recording medium is thick paper. If YES, then the program proceeds to Step S25. If NO, the program proceeds to step S26.

Step S25: The controller 26 selects the THICK PAPER position.

Step S26: The controller 26 makes a decision to determine whether the recording medium is thin paper. If YES, the program proceeds to step S27. If NO, then the program proceeds to step S28.

Step S27: The controller 26 selects the THIN PAPER position.

Step S28: The controller 26 selects the ORDINARY PAPER position.

Step S29: The controller 26 reads image data.

Step S30: The controller 26 makes a decision to determine whether the high print duty has been specified. If YES, the program proceeds to step S31. If NO, the program proceeds to step S32.

Step S31: The controller 26 turns off the electromagnetic actuators AC1, AC3, AC4, AC6 and AC8 and turns on the electromagnetic actuators AC2, AC5 and AC7.

In the fourth embodiment, the distribution of pressing force is set based on the information on the recording medium and image data. The conditions of the environment in which the printer and the recording medium are placed, i.e., temperature and humidity may also be used to implement a desired profile of distribution of pressing force. If such environmental conditions are used, creases in the recording medium may be removed by applying the pressing force to crinkled areas of the recording medium, even if the recording member is apt to become crinkled.

While the present invention has been described with respect to the heat roller 11 of the soft roller type, the present invention may also be applicable to a hard roller type heat roller and a belt fixing type heat roller.

Figure 21A:
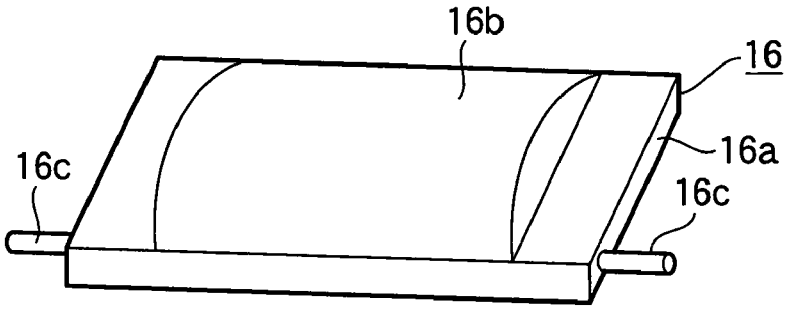
FIGS. 21A-21C illustrate a modification of the cam.
Figure 21B:
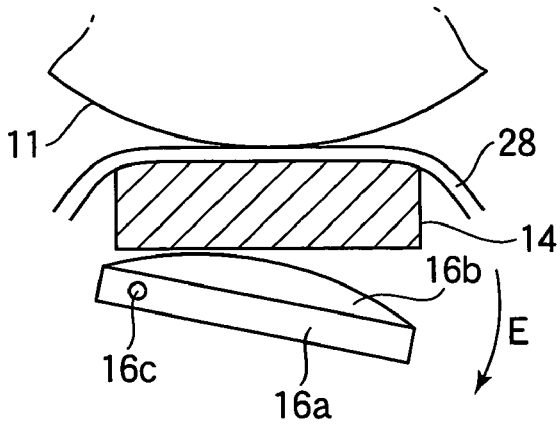
Figure 21C:
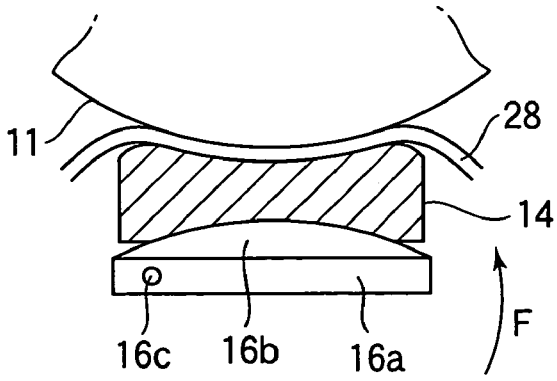
Figure 22A:
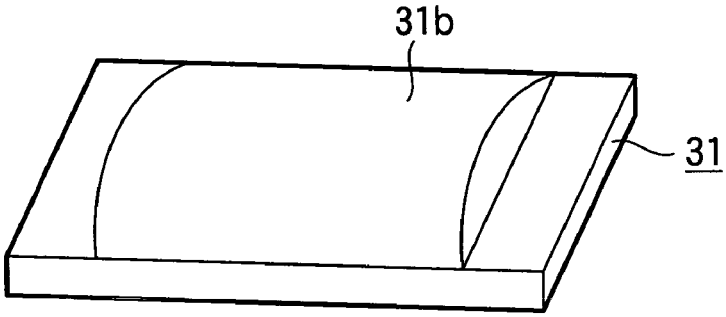
FIGS. 22A-22C illustrate a modification of the cam.
Figure 22B:
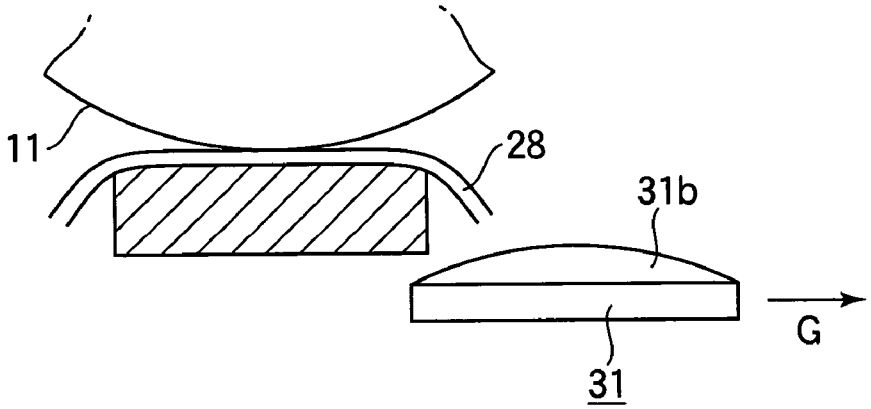
Figure 22C:
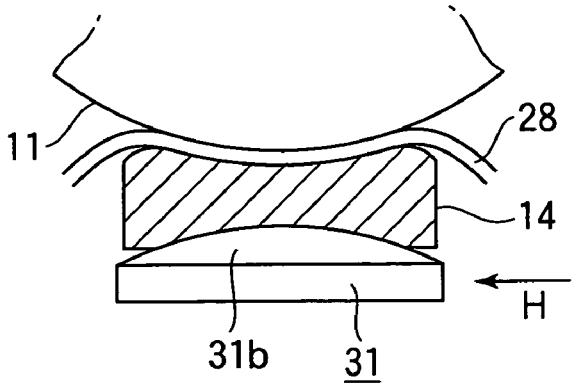

FIG. 21A-21C illustrate modification of the cam 13. FIGS. 22A-22C illustrate a modification of the cam.

The first and second embodiments are configured such that the cam 13 rotates to set a desired profile of the distribution of pressing force. Alternatively, the profile of distribution of pressing force may be set by moving a flat plate-like pressure member 31 in directions shown by arrows G and H along the transport path of the recording medium, the pressure member having a projection 31*b* in a predetermined shape on a plate like member that opposes the pressure pads 14 and 34 as shown in FIG. 22A-22C. Still alternatively, the distribution of pressing force may be set by causing a pressure member 16 to pivot about pins 16*c* in directions shown by arrows E and F, the pressure member having a predetermined projection on a surface that faces the pressure pads 14 and 34 as shown in FIG. 21A-21C.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus comprising:

a heating member that extends in a first direction transverse to a second direction in which a recording medium is advanced;

a belt that is in contact with said heating member to form a fixing region between said belt and said heating member so that the recording medium passes through the fixing region for fixing;

a pressure member that presses said belt against said heating member at a pressing force;

a selecting mechanism that selects one of a plurality of profiles of distribution of the pressing force along the first direction in accordance with information on the recording medium received from a host apparatus; and a pressing mechanism that engages said pressure member to apply the pressing force according to a selected one of the plurality of profiles of distribution of the pressing force selected by the selecting mechanism.

2. The fixing apparatus according to claim 1, wherein said pressing mechanism is a rotatable member that extends in a third direction substantially parallel to the first direction; wherein the rotatable member has a surface that is brought into contact engagement with said pressure member when the rotatable member is rotated, the surface has a predetermined profile of geometry in the third direction such that the pressing force has the predetermined profile of distribution in the first direction.

3. The fixing apparatus according to claim 2, further comprising a deformable resilient member disposed between said pressing mechanism and said pressure member, said deformable resilient member extending in a direction generally parallel to the first direction.

4. The fixing apparatus according to claim 1, wherein said pressing mechanism includes a plurality of sub-mechanisms aligned in a direction generally parallel to the first direction; wherein the plurality of sub-mechanisms are adjustable independently so that each of the plurality of sub-mechanisms applies different amounts of force to said pressure member.

5. An image-forming apparatus comprising a fixing apparatus, wherein the fixing apparatus includes:

a heating member that extends in a first direction transverse to a second direction in which a recording medium is advanced;

a belt that is in contact with said heater member to form a fixing region between said belt and said heating member so that the recording medium passes through the fixing region for fixing;

a pressure member that presses said belt against said heating member;

a selecting mechanism that selects one of a plurality of profiles of distribution of the pressing force along the first direction;

a pressing mechanism that engages said pressure member to apply the pressing force according to a selected one of the plurality of profiles of distribution of the pressing force selected by said selecting mechanism; and a controller that drives said selecting mechanism to select one of the pluralities of profiles of distribution of the pressing force in accordance with information on the recording medium from a host apparatus.

6. The image-forming apparatus according to claim 5, wherein said pressing mechanism is rotatable and extends in a third direction substantially parallel to the first direction, wherein said pressing mechanism has a surface that is brought into contact engagement with said pressure member to apply a pressing force to said pressure member toward the fixing region when the rotatable member is rotated, the surface having a predetermined profile of geometry in the third direction such that the pressing force has the predetermined profile of distribution in the first direction.

7. The image-forming apparatus according to claim 6, wherein said fixing apparatus further comprises a deformable resilient member disposed between said pressing mechanism and said pressure member, said deformable resilient member extending in a direction generally parallel to the first direction.

8. The image-forming apparatus according to claim 5, wherein said pressing mechanism includes a plurality of sub-mechanisms aligned in a direction generally parallel to the first direction; wherein the plurality of sub-mechanisms are adjustable independently so that each of the plurality of sub-mechanisms applies different amounts of force to said pressure member.

9. An image forming apparatus comprising:

an environmental condition detector that detects environmental temperature and humidity;

a selecting mechanism that selects one of a plurality of profiles of distribution of the pressing force along the first direction;

a pressing mechanism that engages said pressure member to apply the pressing force according to one of the plurality of profiles of distribution of the pressing force selected by said selecting mechanism; and a controller that drives said selecting mechanism to select one of the pluralities of profiles of distribution of the pressing force in accordance with at least one of environmental temperature and humidity.

10. the image forming apparatus according to claim 6, wherein the controller drives said pressing mechanism in accordance with one of environmental temperature and humidity.

11. The image forming apparatus according to claim 7, wherein the controller drives said pressing mechanism in accordance with one of environmental temperature and humidity.

12. The image forming apparatus according to claim 8, wherein the controller drives the plurality of sub-mechanisms in accordance with one of environmental temperature and humidity.

13. The image forming apparatus according to claim 5, wherein the controller determines a print duty based on image data that should be printed on the recording medium, said controller adjusting the profile of distribution in accordance with the print duty.

14. The image forming apparatus according to claim 8, wherein the controller determines a print duty based on image data that should be printed on the recording medium, said controller adjusting the profile of distribution in accordance with the print duty.

15. The fixing apparatus according to claim 1, wherein the profile of distribution of the pressing force is such that a larger force is exerted on an area in which the recording medium passes than on an area in which the recording medium does not pass.

16. The image-forming apparatus according to claim 5, wherein the profile of distribution of the pressing force is such that a larger force is exerted on an area in which the recording medium passes than on an area in which the recording medium does not pass.

17. The image-forming apparatus according to claim 1 wherein said pressing mechanism is a rotatable member that extends substantially parallel to the first direction, wherein the rotatable member has a surface that is brought into contact engagement with said pressure member when the rotatable member is rotated, the surface having a plurality of areas each of which has a corresponding one of a plurality of profiles of geometry, wherein when said selecting mechanism is positioned at a first position, a first one of the plurality of areas is brought into contact engagement with said pressure member, and when said selecting mechanism is positioned at the second position, a second one of the plurality of areas is brought into contact engagement with said pressure member.

18. The image-forming apparatus according to claim 5 wherein said pressing mechanism is a rotatable member that extends substantially parallel to the first direction, wherein the rotatable member has a surface that is brought into contact engagement with said pressure member when the rotatable member is rotated, the surface has a predetermined profile of geometry such that the pressing force has the predetermined profile of distribution in the first direction.

* * * * *